United States Patent [19]

Gawlick et al.

[11] 4,014,963

[45] Mar. 29, 1977

[54] MOLDING A PRIMER CHARGE WITHIN A CASELESS PROPELLANT CHARGE

[75] Inventors: Heinz Gawlick, Furth, Bay; Guenther Marondel, Erlangen, both of Germany

[73] Assignee: Dynamit Nobel Aktiengesellschaft, Germany

[22] Filed: May 23, 1975

[21] Appl. No.: 580,357

Related U.S. Application Data

[60] Division of Ser. No. 445,896, Feb. 26, 1974, Pat. No. 3,911,825, which is a continuation of Ser. No. 163,173, July 16, 1971, abandoned.

[30] Foreign Application Priority Data

July 18, 1970 Germany ..... 2035851

[52] U.S. Cl. ..... 264/3 R; 86/20 R; 102/45; 102/DIG. 1; 102/38

[51] Int. Cl.[2] ..... C06B 21/00

[58] Field of Search ..... 102/38, 45, 39, 100, 102/DIG. 1; 264/3 R; 86/20 R, 1 R

[56] References Cited

UNITED STATES PATENTS

| | | | |
|---|---|---|---|
| 3,345,945 | 10/1967 | Quinlan et al. | 102/38 |
| 3,372,643 | 3/1968 | Kvavle | 102/99 |
| 3,420,137 | 1/1969 | Staba | 264/3 R X |
| 3,485,901 | 12/1969 | Quinlan | 264/3 R |
| 3,741,122 | 6/1973 | Kordas | 102/DIG. 1 X |
| 3,754,510 | 8/1973 | Marondel et al. | 102/DIG. 1 X |

*Primary Examiner*—Edward A. Miller
*Attorney, Agent, or Firm*—Craig & Antonelli

[57] ABSTRACT

A caseless formed propellant powder charge including a shaped propellant powder charge having a central continuous recess or hole and a percussion-sensitive primer charge with an H-shaped cross section disposed in the recess. Preferably, the shaped propellant charge and the primer charge are fabricated from materials such as nitrocellulose, polyvinyl nitrate, nitroguanidine, penthrite, or mixtures thereof, and tetrazene or tetrazene tricinate, respectively. The compression and dimensioning of the various portions of the H-shaped primer charge may be modified to achieve the desired sensitivity.

9 Claims, 3 Drawing Figures

MOLDING A PRIMER CHARGE WITHIN A CASELESS PROPELLANT CHARGE

This is a division of application Ser. No. 445,896, filed Feb. 26, 1974 now U.S. Pat. No. 3,911,825, which is a continuation of application Ser. No. 163,173 filed July 16, 1971, now abandoned.

This invention relates to a formed propellant powder charge including a shaped propellant powder charge of slow-burning or deflagrating explosive materials which do not tend toward detonation, such as nitrocellulose, polyvinyl nitrate, nitroguanidine, penthrite, etc. or mixtures thereof, particularly for commercial appliances, such as stud driving tools, impact tools, operating mechanisms, quick-action switches, or the like. The shaped propellant charge of the prior art is exemplified by applicants' U.S. Pat. No. 3,580,180 issued May 25, 1971 in which the shaped propellant powder charge is provided with a preferably central continuous recess or hole in which a primer charge including impact ignitable powder, such as, for example, tetrazene or tetrazene tricinate is accommodated. These formed propellant powder charges constitute caseless propellant cartridges which burn without leaving any residue for commercial and industrial apparatus not employing a projectile for driving studs and the like. Such cartridges are ignited in substantially closed combustion chambers of the type disclosed in U.S. Pat. No. 3,283,657 Kvavle, issued Nov. 8, 1966 in which the gases evolving from the deflagration of the cartridge are utilized to operate the device or tool.

The formed propellant powder charge can exhibit varying sizes and varying shapes, e.g. annular or polygonal, depending on the purpose for which it is employed. Advantageously, in the manufacture of the formed propellant powder charges, the central recesses of the shaped charges always exhibit the same diameter.

Varying the thickness, and thus the power, of the shaped propellant powder charges, while keeping the outer diameter constant, correspondingly modifies the percussion sensitivity of the primer charge in the recess. An increase in thickness of the shaped propellant charge produces an increase in the thickness of the primer charge, whereby the sensitivity is reduced. Conversely, in case of a very thin shaped propellant powder charge, the amount of primer to be accommodated in the recess can be so small as to be insufficient for ignition.

It is an object of the present invention to overcome the above-described disadvantages and to provide a possibility for varying the percussion sensitivity of the formed propellant powder charge. In accordance with the invention, this is accomplished in a shaped propellant powder charge having a central recess by forming the percussion-sensitive powder charge contained therein as a molded article, with an H-shaped cross section. Advantageously, the legs of the H-shaped profile are fashioned to correspond to the height of the shaped charge.

In accordance with another feature of the invention, the percussion or impact-sensitive primer charge is compressed more densely in the zone of the central web than in the zone of the two legs of the H-shaped profile. In a molded article formed in this manner, the more strongly compressed central web serves solely for igniting the primer charge by percussion, whereas the less compressed legs serve for transmitting the ignition flame from the central web to the adjoining shaped propellant powder charge. In addition to modifying the compression of the primer charge in the zone of the central web, the height of the central web can also be altered. By varying the height of the central web, the desired or required sensitivity limit can be set for the primary charge of percussion-sensitive powder pressed in an H-profile.

In the manufacture of the formed propellant powder charge according to the present invention, the percussion-sensitive powder or primer charge is introduced into the central recess, core or opening of the shaped propellant powder charge in the moist or dry state. By inserting from both sides, respectively, a die having a smaller diameter than the recess, the primer charge in the central zone is compressed to form the central web. The superfluous primer charge is distributed toward the margin on all sides until it reaches the upper and/or lower edge of the shaped propellant powder charge. At this point, the primer charge is prevented from being pressed further outwardly beyond the edges of the shaped propellant charge by means of an appropriate tool. By conducting this pressing step, a profile of the compressed primer charge is obtained which has an H-shaped cross section and wherein the central web, in accordance with the controllable insertion paths of the dies, has a definite height and compression. The legs of the thus-formed profile are not as strongly compressed as the central web in this operation, so that the legs quickly transmit the ignition flame due to their greater porosity. In any event, the primer charge is still compressed to such an extent in the area of the legs that it is in sufficiently intimate contact with the inner side of the shaped propellant powder charge to insure a satisfactory friction seat in the recess of the shaped charge.

Various embodiments of the invention will be explained in greater detail below with reference to the attached drawings wherein.

Figure 1:
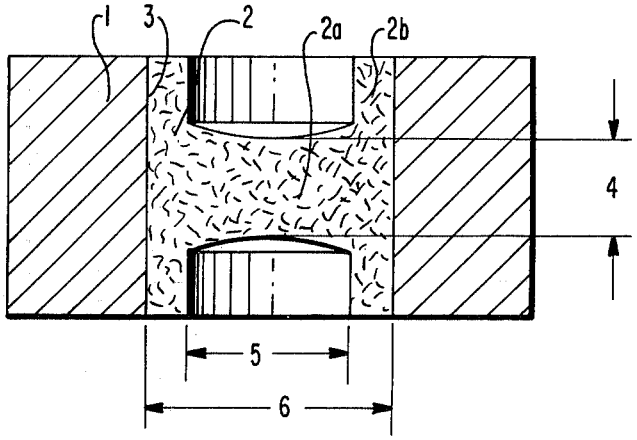
FIG. 1 shows a cross section of a caseless formed propellant powder charge.
Figure 2:
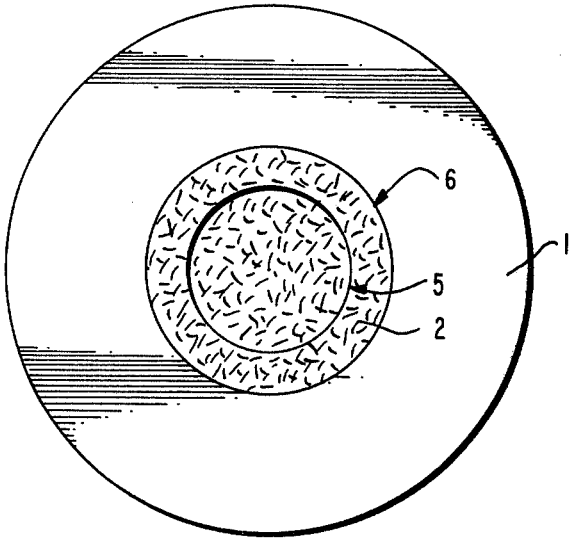
FIG. 2 is a top view of the formed propellant powder charge of FIG. 1.
Figure 3:
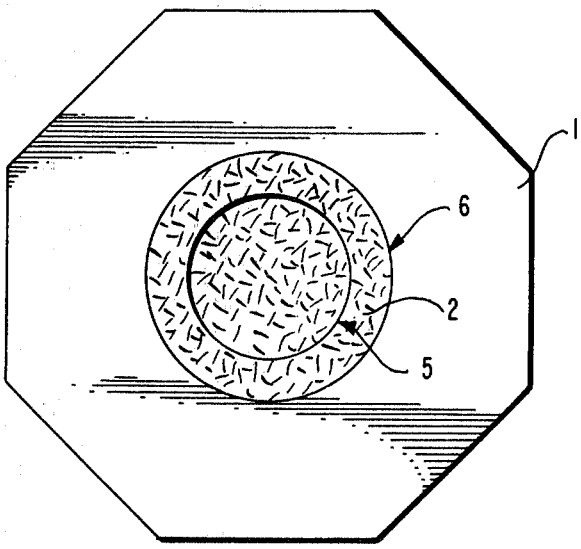
FIG. 3 is a top view of a modified formed propellant powder charge.

Referring to the drawings, shaped propellant charge 1, which may be shaped by casting or compressed from porous powder, and preferably comprises single-base or double-base nitrocellulose powders, is formed with continuous central recess 3 having diameter 6. The external shape of shaped propellant powder charge 1 can be varied in a multitude of ways, e.g., the annular-cylindrical configuration of FIG. 2, the octagonal ring of FIG. 3, etc.

Primer charge 2 of a percussion-sensitive mixture, such as tetrazene and nitrocellulose, is accommodated in recess 3. The percussion-sensitive mixture is then compressed into a shaped article having H-shaped cross section profile with central web **2*a* and legs 2*b*. The ends of legs 2*b* are flush, in each case, with the upper and lower edge, respectively, of shaped propellant powder charge 1. Height 4 and length or diameter 6 of central web 2*a* can be varied as desired. In other words, the sensitivity limit of the primer charge can be set with the aid of the height 4. By employing a primer charge of a commercially available primer composition made into a paste with nitrocellulose and having a compression of about 50 kp/cm² to 500 kp/cm², depending on the moisture of the composition, one obtains, for example, at a height of the web of 1.2 mm., a sensitivity limit of about 70 cm. kp and at a height of the web of 1.3 mm., a limit of about 80 cm. kp. A uniform quality of the H-shaped primer charge is insured, for instance, by the following manufacturing method. The pressing dies, not shown, have diameter 5 which is smaller than diameter 6 of the recess. Upon the introduction of the dies, only the powder between the dies is compressed to form central web 2***a*, and the superfluous powder escapes toward the sides up to the upper or lower edge of the shaped propellant powder charge. Central web 2*a* receives a specific compression and height which is reproducible as many times as desired by this process, whereas the excess amounts, which can also be distributed non-uniformly in quantity, are displaced into the lateral space of recess 3 forming legs 2*b* of the H-shaped profile. The height of central web 2*a* can be manufactured, for example, at a tolerance of ±0.2 mm., and the sensitivity limit, fixed in a correspondingly accurate fashion.

In the preferred commercial field of application for the shaped propellant powder charge 1, a large range of variations exists for choice of diameter 6 of recess 3 and diameter 5 of central web 2*a*. A ratio of the two diameters with respect to each other in the range of from 2 : 1 to 2 : 1.8 has been found advantageous. Height 4 of the central web will preferably be about 0.25 mm. to 1.5 mm. and, in this connection, will be independent of the height of shaped propellant powder charge 1. By the formation of primer charge 2 within recess 3, as provided by the present invention, it is thus possible to determine and vary the sensitivity limit by means of the configuration of central web 2*a*, at a constant diameter of recess 3, regardless of the height and outer diameter of shaped propellant powder charge 1. It is therefore possible to achieve a uniform quality of formed propellant powder charges with primer charge, as well as the adaptation thereof to varying ignition or priming conditions.

Although only two embodiments have been specifically described and shown in the attached drawings, as is readily apparent to one skilled in the art, further embodiments, variations and changes may be made within the scope of the invention.

We claim:

1. A process for making a caseless propellant charge comprising providing a shaped propellant powder charge having a hole therethrough, introducing a percussion-sensitive mixture into said hole and compressing the central portion of said percussion-sensitive mixture on both sides thereof in a manner such that superfluous portions of said mixture are displaced to the periphery of the hole to line the interior of said shaped propellant powder charge whereby a primer charge having an H-shaped cross section is formed in said hole.

2. The process of claim 1 wherein the compressing step is achieved by using a pair of dies having diameters corresponding to the diameter of the central web of the H-shaped cross section.

3. The process of claim 1 wherein the initial percussion-sensitive mixture is in a dry state.

4. The process of claim 1, wherein the step of compressing includes controlling the thickness of the central web of the H-shaped cross section to control the sensitivity of the primer charge.

5. The process of claim 1, wherein the step of compressing includes varying the density in different areas of the H-shaped cross section of the percussion-sensitive mixture.

6. The process of claim 5, wherein the step of varying the density includes providing a more densely compressed percussion-sensitive mixture in the zone of the central web of the H-shaped cross section than in the zone of the two legs of the H-shaped cross section.

7. The process of claim 1, wherein the initial percussion-sensitive mixture is in a moist state.

8. The process of claim 1, further including controlling the height of the legs of the H-shaped cross section so as to not extend beyond the ends of the shaped propellant powder charge.

9. The process of claim 1, wherein the step of compressing includes utilizing a pair of dies.

* * * * *